US009726004B2

(12) United States Patent
Echols, III et al.

(10) Patent No.: US 9,726,004 B2
(45) Date of Patent: Aug. 8, 2017

(54) DOWNHOLE POSITION SENSOR

(71) Applicant: HALLIBURTON ENERGY SERVICES, INC., Houston, TX (US)

(72) Inventors: Ralph Harvey Echols, III, Rockwall, TX (US); William Mark Richards, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 194 days.

(21) Appl. No.: 14/400,417

(22) PCT Filed: Nov. 5, 2013

(86) PCT No.: PCT/US2013/068417
§ 371 (c)(1),
(2) Date: Nov. 11, 2014

(87) PCT Pub. No.: WO2015/069214
PCT Pub. Date: May 14, 2015

(65) Prior Publication Data

US 2016/0273348 A1 Sep. 22, 2016

(51) Int. Cl.
*E21B 47/09* (2012.01)
*E21B 17/02* (2006.01)
(Continued)

(52) U.S. Cl.
CPC ..... *E21B 47/09* (2013.01); *E21B 17/026* (2013.01); *E21B 17/206* (2013.01);
(Continued)

(58) Field of Classification Search
CPC ..... E21B 47/09; E21B 47/065; E21B 17/026; E21B 47/0905; E21B 17/206; E21B 47/123; E21B 17/00; E21B 47/122
See application file for complete search history.

(56) References Cited

U.S. PATENT DOCUMENTS 4,945,775 A 8/1990 Adams et al.
5,275,038 A 1/1994 Sizer et al.
(Continued)

FOREIGN PATENT DOCUMENTS

EP 1096271 5/2001
EP 1096272 5/2001
(Continued)

OTHER PUBLICATIONS

"Acoustic Telemetry System", Halliburton Testing and Subsea, 2010, 4 pages.
(Continued)

*Primary Examiner* — Brad Harcourt
(74) *Attorney, Agent, or Firm* — Kilpatrick Townsend & Stockton LLP

(57) ABSTRACT

A wellbore system can include a completion assembly having a completion string. The system can also include a service string that can be positioned within an inner diameter of the completion string. A location-sensing component can be positioned on the completion string or the service string. A communication link communicatively coupled with the location-sensing component can transmit signals representing a stimuli detected by the location-sensing component. A stimuli-producing device can output the stimuli that is detected by the location-sensing component. A stimuli-producing device can be positioned on the other of the completion string or the service string.

14 Claims, 8 Drawing Sheets

(51) Int. Cl.

| | |
|---|---|
| ***E21B 17/20*** | (2006.01) |
| ***E21B 47/06*** | (2012.01) |
| *E21B 17/00* | (2006.01) |
| *E21B 47/12* | (2012.01) |

(52) U.S. Cl.

CPC ..... *E21B 47/065* (2013.01); *E21B 47/0905* (2013.01); *E21B 47/123* (2013.01); *E21B 17/00* (2013.01); *E21B 47/122* (2013.01)

(56) References Cited

U.S. PATENT DOCUMENTS

| | | | |
|---|---|---|---|
| 5,419,188 | A | 5/1995 | Rademaker et al. |
| 5,579,842 | A | 12/1996 | Riley |
| 5,666,050 | A | 9/1997 | Bouldin et al. |
| 5,925,879 | A | 7/1999 | Hay |
| 6,018,501 | A | 1/2000 | Smith et al. |
| 6,075,461 | A | 6/2000 | Smith |
| 6,177,882 | B1 | 1/2001 | Ringgenberg et al. |
| 6,268,911 | B1 | 7/2001 | Tubel et al. |
| 6,269,198 | B1 | 7/2001 | Hodgson et al. |
| 6,288,975 | B1 | 9/2001 | Frederick et al. |
| 6,481,495 | B1 | 11/2002 | Evans |
| 6,724,319 | B1 | 4/2004 | Knaack et al. |
| 6,728,165 | B1 | 4/2004 | Roscigno et al. |
| 6,769,805 | B2 | 8/2004 | Williams et al. |
| 6,787,758 | B2 | 9/2004 | Tubel et al. |
| 6,828,547 | B2 | 12/2004 | Tubel et al. |
| 6,913,079 | B2 | 7/2005 | Tubel |
| 6,915,686 | B2 | 7/2005 | Baustad |
| 6,943,340 | B2 | 9/2005 | Tubel et al. |
| 6,978,832 | B2 | 12/2005 | Gardner et al. |
| 7,028,543 | B2 | 4/2006 | Hardage et al. |
| 7,040,390 | B2 | 5/2006 | Tubel et al. |
| 7,054,011 | B2 | 5/2006 | Zhu et al. |
| 7,201,221 | B2 | 4/2007 | Tubel et al. |
| 7,201,231 | B2 | 4/2007 | Chaplin et al. |
| 7,219,729 | B2 | 5/2007 | Bostick, III et al. |
| 7,228,900 | B2 | 6/2007 | Schultz et al. |
| 7,240,738 | B2 | 7/2007 | Pendleton |
| 7,245,382 | B2 | 7/2007 | Ronnekleiv |
| 7,254,999 | B2 | 8/2007 | Bostick, III |
| 7,278,480 | B2 | 10/2007 | Longfield et al. |
| 7,284,606 | B2 | 10/2007 | Coronado |
| 7,357,021 | B2 | 4/2008 | Blacklaw |
| 7,417,920 | B2 | 8/2008 | Hahn et al. |
| 7,436,320 | B2 | 10/2008 | Miller, Jr. |
| 7,565,834 | B2 | 7/2009 | Adnan et al. |
| 7,740,064 | B2 | 6/2010 | McCoy et al. |
| 7,797,996 | B2 | 9/2010 | Bostick, III |
| 7,857,066 | B2 | 12/2010 | DiFoggio et al. |
| 7,881,155 | B2 | 2/2011 | Close |
| 7,932,834 | B2 | 4/2011 | Beique et al. |
| 7,946,341 | B2 | 5/2011 | Hartog et al. |
| 7,982,632 | B2 | 7/2011 | Miller, Jr. |
| 7,997,340 | B2 | 8/2011 | Bostick, III et al. |
| 8,109,333 | B2 | 2/2012 | Yee |
| 8,237,443 | B2 | 8/2012 | Hopmann et al. |
| 8,430,163 | B2 | 4/2013 | Dupont |
| 2001/0042617 | A1 | 11/2001 | Beck et al. |
| 2002/0092649 | A1 | 7/2002 | Bixenman et al. |
| 2002/0104652 | A1 | 8/2002 | Cole et al. |
| 2003/0102980 | A1 | 6/2003 | Koro et al. |
| 2003/0205083 | A1 | 11/2003 | Tubel et al. |
| 2004/0043501 | A1 | 3/2004 | Means et al. |
| 2004/0140092 | A1 | 7/2004 | Robison |
| 2004/0156265 | A1 | 8/2004 | Lavrut et al. |
| 2004/0163809 | A1 | 8/2004 | Mayeu et al. |
| 2004/0194958 | A1 | 10/2004 | Mayeu et al. |
| 2005/0012036 | A1 | 1/2005 | Tubel et al. |
| 2005/0062979 | A1 | 3/2005 | Zhu et al. |
| 2005/0263279 | A1 | 12/2005 | Vachon et al. |
| 2006/0081413 | A1 | 4/2006 | Minto |
| 2007/0012460 | A1 | 1/2007 | Coronado |
| 2007/0139217 | A1 | 6/2007 | Beique et al. |
| 2007/0285274 | A1 | 12/2007 | Esmersoy |
| 2008/0264631 | A1* | 10/2008 | Mendez ..... E21B 47/04 166/250.01 |
| 2008/0294344 | A1 | 11/2008 | Sugiura |
| 2009/0034368 | A1 | 2/2009 | Johnson |
| 2009/0071645 | A1 | 3/2009 | Kenison et al. |
| 2009/0128141 | A1 | 5/2009 | Hopmann et al. |
| 2009/0188665 | A1 | 7/2009 | Tubel et al. |
| 2009/0199630 | A1 | 8/2009 | DiFoggio et al. |
| 2009/0201764 | A1 | 8/2009 | Liu |
| 2009/0301184 | A1 | 12/2009 | Irani et al. |
| 2010/0013663 | A1 | 1/2010 | Cavender et al. |
| 2010/0018303 | A1 | 1/2010 | Bostick, III |
| 2010/0166358 | A1 | 7/2010 | Homa et al. |
| 2010/0303426 | A1 | 12/2010 | Davis |
| 2010/0309019 | A1 | 12/2010 | Shah et al. |
| 2011/0163891 | A1 | 7/2011 | Wilson et al. |
| 2011/0280105 | A1 | 11/2011 | Hall et al. |
| 2012/0037360 | A1 | 2/2012 | Arizmendi, Jr. et al. |
| 2012/0046866 | A1 | 2/2012 | Meyer et al. |
| 2012/0080231 | A1 | 4/2012 | Radford et al. |
| 2012/0147924 | A1 | 6/2012 | Hall |
| 2012/0152562 | A1 | 6/2012 | Newton et al. |
| 2012/0175135 | A1 | 7/2012 | Dyer et al. |
| 2012/0176250 | A1 | 7/2012 | Duncan et al. |
| 2012/0211231 | A1 | 8/2012 | Erkol et al. |
| 2012/0256635 | A1 | 10/2012 | Gissler |
| 2012/0286967 | A1 | 11/2012 | Alteirac et al. |
| 2013/0016979 | A1 | 1/2013 | Duncan et al. |
| 2013/0021874 | A1 | 1/2013 | Hartog et al. |
| 2013/0075161 | A1 | 3/2013 | Yang |
| 2013/0087328 | A1 | 4/2013 | Maida, Jr. et al. |
| 2014/0014329 | A1 | 1/2014 | Radford et al. |
| 2014/0251603 | A1* | 9/2014 | Raducanu ..... E21B 47/09 166/255.1 |
| 2015/0077265 | A1 | 3/2015 | Shah et al. |
| 2015/0167430 | A1 | 6/2015 | Purkis et al. |

FOREIGN PATENT DOCUMENTS

| | | |
|---|---|---|
| EP | 1096273 | 5/2001 |
| GB | 2364380 | 1/2002 |
| GB | 2436473 | 9/2007 |
| WO | 9850681 | 11/1998 |
| WO | 9857030 | 12/1998 |
| WO | 03017538 | 2/2003 |
| WO | 2015099641 | 7/2015 |
| WO | 2015102582 | 7/2015 |
| WO | 2015112127 | 7/2015 |

OTHER PUBLICATIONS

"Bumper Spring with Collet Latch", Ferguson Bearegard, 2012, 1 page.

"EM Telemetry Tool for Deep Well Drilling Applications", Deep Trek Program Solicitation, E-Spectrum Technologies, Inc., 2 pages.

"Fiber Optic Sensing Technologies for Well Monitoring to Reservoir Management", Pinanacle, 2012, 7 Pages.

"Permanent Downhole Monitoring", Weatherford, 2006, 16 pages.

"Permanent Downhole Monitoring Solutions", Promore, Core Lab Reservoir Optimization www.promore.com, 2 pages.

"SureView Real-Time Fiber-Optic Compaction Monitoring System", The SureView RTCM system Baker Hughes, 2010, 4 pages.

Andren et al., "Integrated Ocean Drilling Program", Expedition 347 Scientific Prospectus, 61 pages.

Camwell et al., "Acoustic Telemetry, with Multiple Nodes in Drillstring, used to Achieve Distributed MWD", Innovating While Drilling, Mar./Apr. 2009, pp. 1-6.

Dria , "E&P Applications of Fiber Optic Technologies", Myden Energy Consulting PLLC, May 2012, 47 pages.

Fernandez et al., "Integrated drilling system using mud actuated down hole hammer as primary engine", Novatek, Report #34365R05, May 1996, 35 pages.

Harper et al., "Advanced Acoustic Telemetry System Provides Real-time Data Acquisition that Increases Efficiency in Well Testing Operations", Offshore Technology Conference, May 5-8, 2003, 16 pages.

(56) References Cited

OTHER PUBLICATIONS

Lienau, "Direct-Use Downhole Pumps", Geo-Heat Center Quarterly Bulletin vol. 8, No. 3, 1984, 7 Pages.
International Patent Application No. PCT/US2013/068417, International Search Report and Written Opinion mailed Jul. 24, 2014, 17 pages.
Skinner et al., "Downhole Fiber-optic Sensing: The Oilfield Service Provider's Perspective", Halliburton Energy Services, Fiber Optic Sensor Technology and Applications III, Proc. of SPIE vol. 5589, 2004, pp. 206-220.
Wassermann et al., "How High-Speed Telemetry Affects the Drilling Process", JPT, Jun. 2009, 4 pages.

* cited by examiner

DOWNHOLE POSITION SENSOR

CROSS-REFERENCE TO RELATED APPLICATIONS

This is a U.S. national phase under 35 U.S.C. 371 of International Patent Application No. PCT/US2013/068417, titled "Downhole Position Sensor" and filed Nov. 5, 2013, the entirety of which is incorporated herein by reference.

TECHNICAL FIELD

The present disclosure relates generally to a downhole position sensor for determining a position of a service string within a bore in a subterranean formation, and more particularly (although not necessarily exclusively), to methods and assemblies for sensing a stimulus produced by the service string and communicating to the surface the location of the service string based on the stimulus.

BACKGROUND

Various assemblies can be installed in a well traversing a hydrocarbon-bearing subterranean formation. During well drilling and completion, a service string can be positioned within a wellbore to perform certain functions. Knowing the position of the service string within the wellbore can reduce damage to the well that can occur if a tool on the service string is activated at the incorrect location within the wellbore. Knowledge of the service string's location within a wellbore is particularly useful in multi-zone wellbores where the service string can be repositioned within various zones. Knowing the location of the service string can help properly position the service string with respect to each zone.

DETAILED DESCRIPTION

Figure 1:
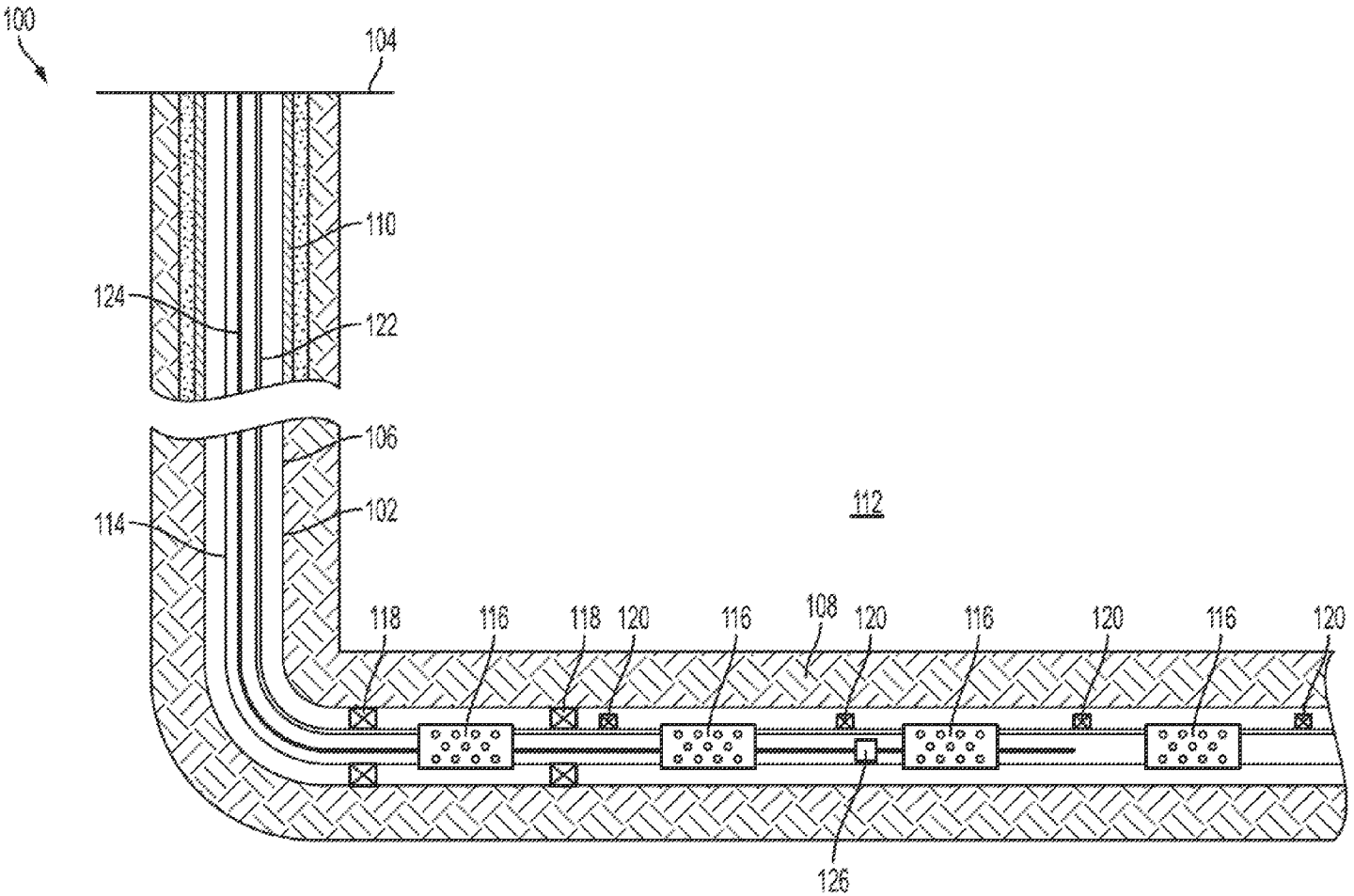
FIG. 1 is a schematic illustration of a well system having a downhole position sensor and a service string positioned downhole, according to one aspect.

Certain aspects and features relate to a wellbore assembly with a downhole position sensor for sensing stimulus produced by a service string and communicating to a surface the locations of the service string based on the stimulus. For example, a service string can be positioned within the wellbore assembly and can include a stimuli-producing device. The downhole position sensor can include location-sensing components or sensors, such as electric gauges. An example of another sensor includes a fiber optic cable and an electric hall sensor. The sensors can be positioned along a length of the wellbore assembly. The wellbore assembly can be a completion assembly. The sensors can detect, in real time, the stimuli produced by the stimuli-producing device along the length of the wellbore. The downhole position sensor can also include a communication link that can provide communication, in real time, between the sensors and the surface of the wellbore. The communication link can be an electric cable. Another example of a communication link can be a fiber optic cable. The communication link can also be used for additional purposes during the life of the well or otherwise can remain within the wellbore for the life of the well. For example, in one aspect a fiber optic cable can monitor the temperature within the wellbore during the life of the well.

The stimuli-producing device can include a temperature source, a vibration source, a magnet field source, a radio signal source, or other types of sources coupled to a service string. The service string can be a wireline, a coil tubing, a threaded tubing, a drill pipe, or other similar devices. The sensors can include electronic gauges coupled to an electric cable or fiber optic cable and can be mounted in screens or other downhole equipment. The sensors can communicate with surface devices using the communication link. In some aspects, the electric cable or fiber optic cable is positioned within a groove in an outer shroud of a sand control screen element. In another aspect, the electric cable or fiber optic cable is positioned beneath the filter medium of the sand control screen element. In still yet other aspects, the electric cable or fiber optic cable can be positioned beneath a perforated pipe positioned around a tubing string of the wellbore assembly.

For example, the electric gauges can be positioned along an outer surface of a tubing string of the wellbore assembly or disposed partially or fully within an opening in the tubing string. The electric gauges can be coupled to an electric cable that provides communication between the electric gauges and the surface of the wellbore. The electric gauges can sense the stimuli from the service string and a signal representing the sensed stimuli can be communicated to the surface in real time. In another example, a fiber optic cable can be positioned along an outer surface of a tubing string of the wellbore assembly and can sense the stimuli from the service string. The fiber optic cable can also communicate a signal representing the sensed stimuli to the surface.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system 100 having a wellbore assembly according to one aspect. The well system 100 includes a bore that is a wellbore 102 extending through a surface 104 and various earth strata. The wellbore 102 has a substantially vertical section 106 and a substantially horizontal section 108. The substantially vertical section 106 and the substantially horizontal section 108 can include a casing string 110 cemented at an upper portion of the substantially vertical section 106. The substantially horizontal section 108 extends through a hydrocarbon bearing subterranean formation 112.

A tubing string 114 extends from the surface within wellbore 102. The tubing string 114 can be part of a completion assembly and can provide a conduit for formation fluids to travel from the substantially horizontal section 108 to the surface 104. Sand control screen elements 116 are positioned at various production intervals around the tubing string 114. Packers 118 can provide a fluid seal between the tubing string 114 and the wall of the wellbore 102. Each of the packers 118 can define a production interval.

A service string 124 is positioned within the tubing string 114 downhole in the wellbore 102. The service string could be wireline, coil tubing, threaded tubing, drill pipe, or similar device. The service string 124 includes a stimuli-producing device 126. The stimuli-producing device 126 may be a temperature source, a vibration source, a magnetic field source, a radio signal source, or another type of source.

Electric gauges 120 are positioned on an outer surface of the tubing string 114. In some aspects, a single electric gauge 120 can be positioned on the outer surface of the tubing string 114 rather than multiple ones. The electric gauges 120 are coupled to an electric cable 122 that is positioned on the outer surface of the tubing string 114. The electric gauges 120 can sense the stimuli from the stimuli-producing device 126. A signal representing the sensed stimuli can be communicated from the electric gauges 120 to the surface 104 by the electric cable 122. Other types of communication links can be used. For example, the electric cable can be replaced with a fiber optic cable, which can or cannot include electric gauges.

Although FIG. 1 depicts the electric gauges 120 positioned in the substantially horizontal section 108, the electric gauges 120 can be located, additionally or alternatively, in the substantially vertical section 106. Furthermore, any number of the electric gauges 120, including one, can be used in the well system 100 generally or in various intervals. In some aspects, the electric gauges 120 can be disposed in simpler wellbores, such as wellbores having only a substantially vertical section 106. The electric gauges 120 can be disposed in open hole environments, such as is depicted in FIG. 1, or in cased wells. The service string 124 that includes the stimuli-producing device 126 can also be disposed in simpler wellbores and in open hole environments or in cased wells.

Figure 2:
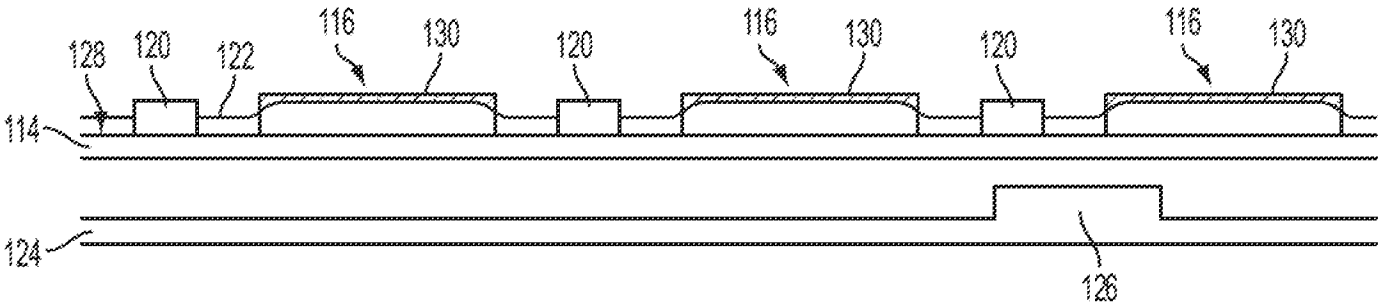
FIG. 2 is a cross-sectional side view of part of the downhole position sensor and the service string positioned downhole from FIG. 1, according to one aspect.

FIG. 2 depicts a cross-sectional side view of part of the downhole position sensor and the service string 124 positioned downhole from FIG. 1, according to one aspect. The service string 124 is positioned within the tubing string 114. The service string 124 includes the stimuli-producing device 126. The stimuli-producing device 126 can be a temperature source. In one aspect, the temperature source can increase the surrounding temperature (e.g., the temperature source is a heat source). In another aspect, the temperature source can decrease the surrounding temperature (e.g., the temperature source is a cold source). In other aspects the stimuli-producing device 126 can be a vibration source, a magnetic field source, or a radio signal source.

The sand control screen elements 116 are positioned around an outer surface 128 of the tubing string 114. The electric gauges 120 are positioned on the outer surface 128 of the tubing string 114 between the sand control screen elements 116. In another aspect, the electric gauges 120 can be positioned partially or fully within an opening in the tubing string 114. The electric gauges 120 can sense the stimuli produced by the stimuli-producing device 126. For example, the electric gauges 120 can sense a change in temperature caused by a temperature source, a vibration produced by a vibration source, a magnetic field produced by a magnetic field source, or a the radio signal produced by a radio signal source.

The electric gauges 120 are coupled to the electric cable 122. The electric cable 122 provides communication between the electric gauges 120 and a surface of the wellbore based on the stimuli produced by the stimuli-producing device 126. The electric cable 122 is positioned on the outer surface 128 of the tubing string 114 and provides for communication between the electric gauges 120 and a surface of the wellbore. The electric cable 122 is positioned within a groove in an outer shroud 130 of the sand control screen elements 116. In other aspects, the electric cable 122 can be positioned under the sand control screen elements 116 or under the outer shroud 130, or any other suitable positions.

In another aspect, the stimuli-producing device 126 can be positioned on the tubing string 114 and the electric gauges 120 and the electric cable 122 can be positioned on the service string 124. The tubing string 114 can be a completion string, in one aspect.

Figure 3:
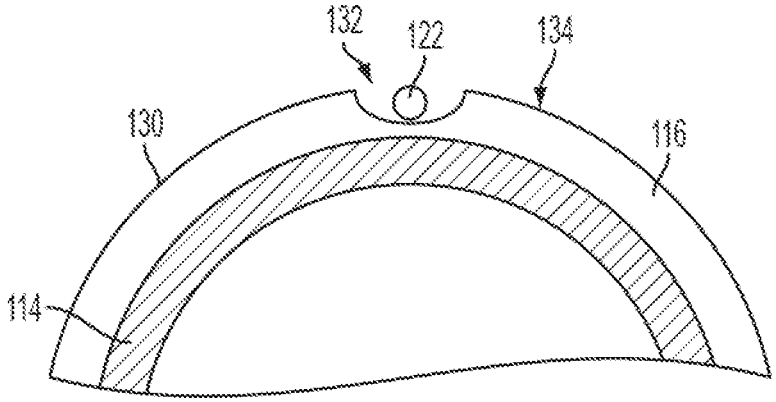
FIG. 3 is a cross-sectional view of part of the downhole position sensor of FIG. 2, according to one aspect.

FIG. 3 depicts the electric cable 122 of FIG. 2 positioned within a groove 132 in the outer shroud 130 of the sand control screen element 116. The electric cable 122 can be protected from damage when the tubing string 114 is inserted within a wellbore by the position of the electric cable 122 within an outer diameter of the sand control screen element 116. For example, a top surface 134 of the outer shroud 130 extends beyond the electric cable 122 and can protect the electric cable 122 during insertion into the wellbore. In another aspect, the electric cable 122 can be positioned interior to the outer shroud 130 of the sand control screen elements 116. In another aspect, the electric cable 122 can be positioned under a perforated pipe positioned around the tubing string 114. In still yet other aspects, a fiber optic cable can be the communication link.

Figure 4:
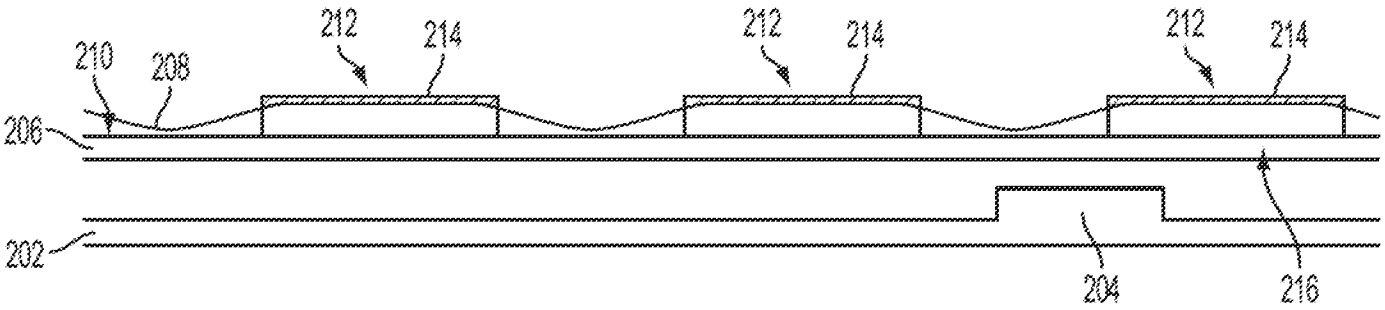
FIG. 4 is a cross-sectional side view of part of a downhole position sensor and a service string positioned downhole, according to another aspect.

FIG. 4 depicts a cross-sectional view of part of a downhole position sensor and a service string 202 positioned downhole, according to another aspect. The service string 202 is positioned within a tubing string 206 of the wellbore assembly. The service string 202 includes a stimuli-producing device 204. The stimuli-producing device 204 is a temperature source. In one aspect, the temperature source can be a heat source. In aspects in which the temperature source is a heat source, heat can be generated chemically, electrically (e.g., by electric heaters), by spent nuclear fuel rods, by pyrotechnic, or by other suitable heat generating means. In another aspect, the temperature source can be a cold source. In aspects in which the temperature source is a cold source, a lower temperature can be generated chemically or by other suitable means.

The tubing string 206 has a fiber optic cable 208 positioned on an outer surface 210 of the tubing string 206. The fiber optic cable 208 can extend from a surface of the wellbore along a length of the tubing string 206. Sand control screen elements 212 are positioned around the outer surface 210 of the tubing string 206. The sand control screen elements 212 can be positioned at various intervals along the tubing string 206. The sand control screen elements 212 include an outer shroud 214 that includes a groove. The fiber optic cable 208 is mounted within the groove in the outer shroud 214. In other aspects, the fiber optic cable 208 can be mounted under the outer shroud 214. In still yet other aspects, the fiber optic cable 208 can be mounted within the tubing string 206.

The fiber optic cable 208 can sense the surrounding temperature along the entire length of the fiber optic cable 208. The fiber optic cable 208 can communicate to the surface of the wellbore a position along the length of the fiber optic cable where there is a change in surrounding temperature.

For example, in one aspect, where the stimuli-producing device 204 is a heat source, the stimuli-producing device 204 can raise the temperature at a location along the tubing string 206 proximate to the stimuli-producing device 204. The temperature at the sand control screen element 212 can also be increased by the stimuli-producing device 204. The fiber optic cable 208 can sense an increase in the surrounding temperature at the location along the fiber optic cable 208 proximate to the sand control screen element 212 whose temperature has been raised. The fiber optic cable 208 can communicate to the surface of the wellbore the location along the length of the fiber optic cable 208 where the temperature increase was sensed. The fiber optic cable 208 can thereby indicate to the surface the location of the service string 202.

In another aspect, the stimuli-producing device 204 can be a temperature source that is a cold source. In this aspect, the fiber optic cable 208 can sense a location along the fiber optic cable 208 where the surrounding temperature has been decreased by the stimuli-producing device 204.

Figure 5:
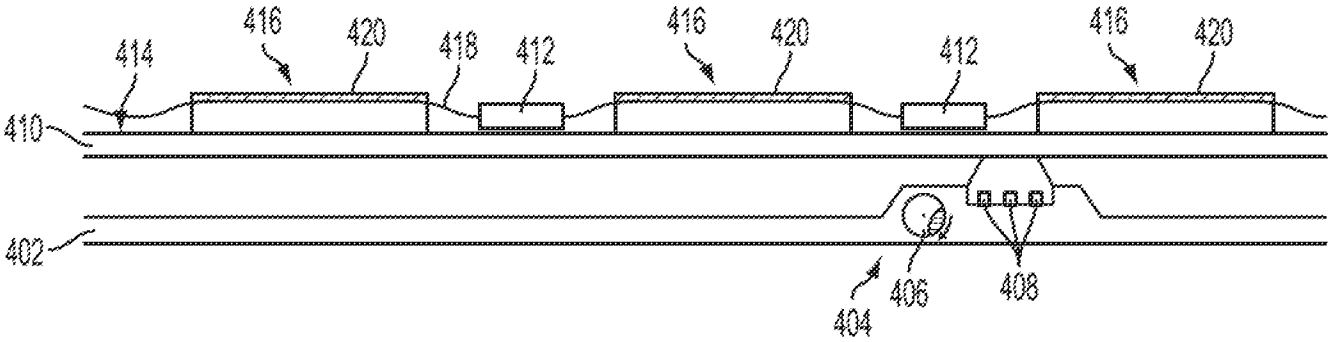
FIG. 5 is a cross-sectional side view of part of a downhole position sensor and a service string positioned downhole, according to another aspect.

FIG. 5 is a cross-sectional side view of part of a downhole position sensor and a service string 402 positioned downhole, according to another aspect. The service string 402 is positioned within a tubing string 410 of a wellbore assembly. The service string 402 includes a stimuli-producing device 404 that is a vibration source. The stimuli-producing device 404 includes a set of offset weights 406 that can be spun. A vibration can be produced as the set of offset weights 406 spin. The stimuli-producing device 404 includes drag blocks 408 that can transmit the vibration produced by the set of offset weights 406 as they spin towards the tubing string 410. The tubing string 410 includes sand control screen elements 416 positioned around an outer surface 414 of the tubing string 410. The drag blocks 408 can transmit the vibration to the sand control screen element 416 proximate to the stimuli-producing device 404. In another aspect, other suitable means can be used to produce a vibration.

Electric gauges 412 are positioned on the outer surface 414 of the tubing string 410 between each of the sand control screen elements 416. In other aspects, the electric gauges 412 can be positioned partially or fully within an opening in the tubing string 410. The electric gauges 412 can detect a vibration transmitted to the sand control screen element 416 proximate to the stimuli-producing device 404 by the drag blocks 408. In some aspects, the electric gauges 412 can detect the vibration transmitted by the drag blocks 408 by the use of accelerometers. The electric gauges 412 can sense a location range of the vibration produced by the spinning set of offset weights 406.

The electric gauges 412 can determine the location, relative to the tubing string 410, where the vibration originated to a surface of the wellbore. The electric gauges 412 can communicate the location where the vibration originated to the surface of the wellbore via an electric cable 418. The electric cable 418 can extend from the surface of the wellbore along the outer surface 414 of the tubing string 410 along a length of the tubing string 410. In another aspect, a fiber optic cable can be used to sense the location of the vibration produced by the spinning set of offset weights 406.

In another aspect, the stimuli-producing device 404 can be an radio signal source. A device capable of receiving radio signals can be positioned along the length of the tubing string 410 and can detect the radio signal produced by the stimuli-producing device 404. The radio signal receiving device can determine, based on the strength of the signal, the location of the source of the radio signal (i.e. the stimuli-producing device 404). The radio signal receive device can communicate to the surface of the wellbore the location of the stimuli-producing device 404 via a communication link, such as a fiber optic cable or electric cable.

Figure 6:
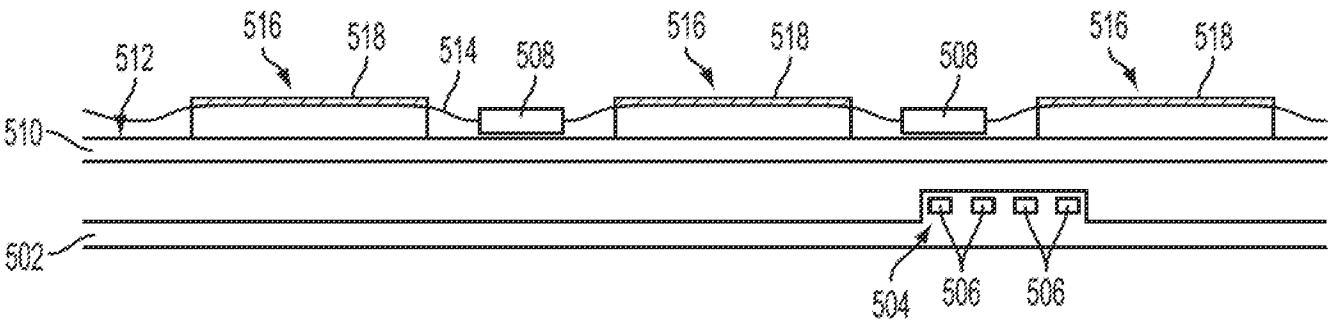
FIG. 6 is a cross-sectional side view of part of a downhole position sensor and a service string positioned downhole, according to another aspect.

FIG. 6 depicts a cross-sectional side view of part of a downhole position sensor and a service string 502 positioned downhole, according to another aspect. The service string 502 is positioned within a tubing string 510 of a wellbore assembly. The service string 502 includes a stimuli-producing device 504 that is a magnetic field source. The stimuli-producing device 504 includes magnets 506 that produce a magnetic field. Though FIG. 6 shows four magnets 506, one or more magnets can be used. Electric hall sensors 508 are positioned along an outer surface 512 of the tubing string 510. The electric hall sensors 508 can detect the magnetic field produced by the magnets 506. The electric hall sensors 508 can communicate the location of the source of the magnetic field (i.e. the stimuli-producing device 504) to the surface of the wellbore via an electric cable 514. In another aspect giant magneto resistive sensors can be used to detect the magnetic field produced by the magnets 506. The electric cable 514 is positioned on the outer surface 512 of the tubing string 510 and is coupled to the electric hall sensors 508. A plurality of sand control screen elements 516 are positioned around an outer surface of the tubing string 510. The electric cable 514 is mounted within a groove in an outer shroud 518 of the sand control screen elements 516. The outer shroud 518 can protect the electric cable 514 from damage during insertion into the wellbore.

Figure 7:
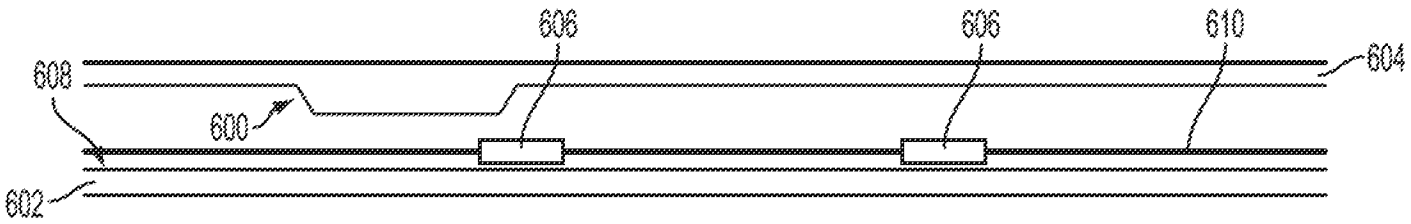
FIG. 7 is a cross-sectional side view of part of a wellbore assembly including a stimuli-producing device and a service string positioned downhole, according to another aspect.

FIG. 7 depicts a cross-sectional side view of part of a wellbore assembly including stimuli-producing device 600 and a service string 602, according to one aspect. The service string 602 is positioned downhole within a tubing string 604. The tubing string 604 includes the stimuli-producing device 600. The stimuli-producing device 600 can be a temperature source. In other aspects the stimuli-producing device 600 can be a vibration source, a magnetic field source, or a radio signal source.

Electric gauges 606 are positioned on an outer surface 608 of the service string 602. In another aspect, the electric gauges 606 can be positioned partially or fully within an opening in the service string 602. The electric gauges 606 can sense the stimuli produced by the stimuli-producing device 600. For example, the electric gauges 606 can sense a change in temperature caused by a temperature source, a vibration produced by a vibration source, a magnetic field produced by a magnetic field source. In an aspect where the stimuli-producing device 600 produces a radio signal, a radio receiver can be used in place of the electric gauges 606.

The electric gauges 606 are coupled to the electric cable 610. The electric cable 610 provides communication between the electric gauges 606 and a surface of the wellbore based on the stimuli produced by the stimuli-producing device 600. The electric cable 610 is positioned on the outer surface 608 of the service string 602 and provides for communication between the electric gauges 606 and a surface of the wellbore. In other aspects, the electric cable 610 can be positioned partially or fully within an inner diameter of the service string 602.

Figure 8:
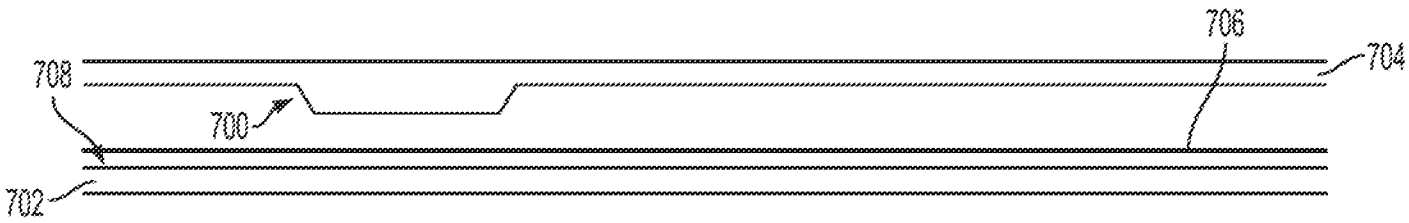
FIG. 8 is a cross-sectional side view of part of a wellbore assembly including a stimuli-producing device and a service string positioned downhole, according to another aspect.

FIG. 8 depicts a cross-sectional side view of part of a wellbore assembly including stimuli-producing device 700 and a service string 702, according to another aspect. The service string 702 is positioned downhole within a tubing string 704 of a wellbore assembly. The wellbore assembly can be a completion assembly. The stimuli-producing device 700 is positioned partially within an inner diameter of the tubing string 704. In another aspect, the stimuli-producing device 700 can be positioned fully within the inner diameter of the tubing string 704. The stimuli-producing device 700 is a heat source. In another aspect, the stimuli-producing device 700 can be a cold source, a vibration source, or a magnetic field source. The service string 702 has a fiber optic cable 706 positioned on an outer surface 708 of the service string 702. In another aspect, the fiber optic cable 706 can be positioned within an inner diameter of the service string 702. The fiber optic cable 706 can extend along a length of the service string 702. The fiber optic cable 706 can sense the surrounding temperature along the entire length of the fiber optic cable 706. The fiber optic cable 706 can communicate to a surface of the wellbore a position along the length of the fiber optic cable 706 where a change in surrounding temperature occurred. For example, the fiber optic cable 706 can sense where along the length of the fiber optic cable 706 the stimuli-producing device 700 caused the surrounding temperature to increase. The fiber optic cable 706 can send a signal to the surface of the wellbore indicating the location along the length of the fiber optic cable 706 where the temperature increase was sensed.

In one aspect, a wellbore system can include a completion assembly having a completion string. The system can also include a service string that can be positioned within an inner diameter of the completion string. A location-sensing component can be positioned on the completion string or the service string. A communication link communicatively coupled with the location-sensing component can transmit signals representing a stimuli detected by the location-sensing component. A stimuli-producing device can be positioned on the other of the completion string or the service string. The stimuli-producing device can output the stimuli that is detected by the location-sensing component.

In another aspect, a wellbore system can include a completion tubular and a location-sensing component. The location-sensing component can be positioned proximate to the completion tubular. The location-sensing component can detect a stimuli from a stimuli-producing device positioned on a service string. The service string can be positioned within an inner diameter of the completion tubular. The location-sensing component can also be communicatively coupled to a surface of the wellbore to communicate a signal to the surface that represents the stimuli.

In another aspect, a method for determining a position of a service string within a wellbore can include producing a stimuli by a stimuli-producing device. The stimuli-producing device can be positioned on the service string. The service string can be positioned within a completion assembly. The method can also include sensing the stimuli by a location-sensing component located on the completion assembly. The location-sensing component can determine an origin location of the stimuli. A communication link can communicate to a surface of the wellbore the origin location of the stimuli.

The foregoing description of the aspects, including illustrated aspects, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A wellbore system, comprising:

a completion assembly including a completion string;

a service string positionable within an inner diameter of the completion string;

a location-sensing component positioned on the completion string or the service string;

a communication link communicatively coupled with the location-sensing component for transmitting a signal representing a stimuli detected by the location-sensing component; and a stimuli-producing device positionable on the other of the completion string or the service string for outputting the stimuli that is detectable by the location-sensing component, wherein the stimuli-producing device is a vibration source, and wherein the vibration source includes at least set of offset weights that produce a vibration in response to being spun and also includes at least one drag block that transmits the vibration.

2. The wellbore system of claim 1, wherein the stimuli-producing device is positioned on the service string and the location-sensing component is positioned proximate to the completion string.

3. The wellbore system of claim 2, further comprising a sand control screen positioned around the completion string, the sand control screen including an outer shroud having a groove, wherein the location sensing component is a fiber optic cable, the fiber optic cable being mounted in the groove in the outer shroud.

4. The wellbore system of claim 3, wherein the fiber optic cable is positioned along a length of the completion string for detecting the stimuli along the length of the completion string.

5. The wellbore system of claim 1, wherein the location-sensing component is a fiber optic cable and the communication link is the fiber optic cable.

6. The wellbore system of claim 1, wherein the stimuli-producing device is positioned on the completion string and the location-sensing component is positioned on the service string.

7. The wellbore system of claim 1, wherein the location-sensing component is a plurality of electronic gauges and the communication link is an electric cable.

8. A wellbore system, comprising:

a completion tubular; and a location-sensing component positionable proximate to the completion tubular;

a stimuli-producing device located on a service string, the service string positionable in an inner diameter of the completion tubular, the location-sensing component communicatively coupled to a surface of a wellbore for detecting a stimuli from the stimuli-producing device and communicating a signal to the surface that represents the stimuli, wherein the stimuli-producing device is a vibration source that includes at least one offset weight that produces a vibration in response to being spun and includes at least one drag block that transmits the vibration.

9. The wellbore system of claim 8, wherein the location-sensing component is a fiber optic cable.

10. The wellbore system of claim 9, further comprising a sand control screen positioned around the completion tubular, the sand control screen including an outer shroud having a groove, the fiber optic cable being mounted in the groove in the outer shroud.

11. The wellbore system of claim 9, wherein the fiber optic cable is positioned along a length of the completion tubular for detecting the stimuli along the length of the completion tubular.

12. A method for determining a position of a service string within a wellbore, the method comprising:

producing, by a stimuli-producing device located the service string positioned within a completion assembly, a stimuli;

sensing, by a location-sensing component located on the completion assembly, the stimuli;

determining, by the location-sensing component, an origin location of the stimuli; and communicating to a surface of the wellbore, by a communication link, the origin location of the stimuli, wherein the stimuli-producing device is a vibration source that includes at least one offset weight that produces a vibration in response to being spun and includes at least one drag block that transmits the vibration.

13. The method of claim 12, wherein sensing the stimuli comprises sensing, by an electric gauge, the stimuli and wherein communicating to the surface of the wellbore comprises communicating by an electronic cable.

14. The method of claim 12, wherein sensing the stimuli comprises sensing, by a fiber optic cable, the stimuli and wherein communicating to the surface of the wellbore comprises communicating by the fiber optic cable.

* * * * *